US007819696B2

(12) United States Patent
Wu

(10) Patent No.: US 7,819,696 B2
(45) Date of Patent: Oct. 26, 2010

(54) SHIELDED CONNECTOR HAVING PROLONGED LATCHES TO PROVIDE RELIABLE RETAINING FORCE TO POSITIONING THE CAMERA MODULE MOUNTED THEREIN

(75) Inventor: Chun-Kung Wu, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 303 days.

(21) Appl. No.: 12/075,151

(22) Filed: Mar. 10, 2008

(65) Prior Publication Data

US 2008/0220650 A1 Sep. 11, 2008

(30) Foreign Application Priority Data

Mar. 9, 2007 (CN) ..... 2007 2 0035288

(51) Int. Cl.
*H01R 13/648* (2006.01)

(52) U.S. Cl. ..... 439/607.01; 439/607.35; 439/607.36; 439/71

(58) Field of Classification Search ..... 439/607.01, 439/607.35, 607.36, 71
See application file for complete search history.

(56) References Cited

U.S. PATENT DOCUMENTS 6,939,172 B2 * 9/2005 Lu ..... 439/607.2
7,223,125 B2 * 5/2007 Chen ..... 439/607.19
7,255,600 B2 * 8/2007 Ma ..... 439/607.04
7,402,082 B2 * 7/2008 Zhang ..... 439/607.54
7,435,139 B2 * 10/2008 Yang ..... 439/607.01
7,435,140 B2 * 10/2008 Wang ..... 439/607.01
7,467,974 B2 * 12/2008 Zhang ..... 439/607.01
7,473,134 B2 * 1/2009 Zhang ..... 439/607.01
7,578,677 B2 * 8/2009 Wu ..... 439/67
7,648,395 B2 * 1/2010 Ma ..... 439/607.01

* cited by examiner

*Primary Examiner*—Gary F. Paumen
(74) *Attorney, Agent, or Firm*—Ming Chieh Chang; Wei Te Chung; Andrew C. Cheng

(57) ABSTRACT

A shielded connector (1) for electrically connecting a camera module to a printed circuit board at least comprises a metal housing (10) configured by a base and four sidewalls and a spring (20) against with the base of the housing. And one of the sidewall includes a fixed portion and a flexible portion. Said flexible portion defines a latchable portion against with the camera module, which extends from an adjacent sidewall to said sidewall towards the opposite sidewall to said adjacent sidewall. Therefore, the elastic of the flexible portion is improved and a better electrical connection is provided between the camera module and a circuit board.

4 Claims, 3 Drawing Sheets

A

SHIELDED CONNECTOR HAVING PROLONGED LATCHES TO PROVIDE RELIABLE RETAINING FORCE TO POSITIONING THE CAMERA MODULE MOUNTED THEREIN

BACKGROUND OF THE INVENTION

1. Field of the Invention

The present invention relates to a shielded connector, and more particularly to an electronic module connector for interconnecting an electronic module such as a camera module for use with a cellular phone or the like to an electrical member such as a printed circuit board. The connector of present invention features a locking finger with a prolonged latch for providing a reliable retaining force to positioning the camera module mounted therein.

2. Description of the Related Art

Conventionally, electronic modules such as a camera module for use with a cellular phone are securely maintained in electrical connection with an electronic member such as a printed circuit board. Therefore, an electrical connector for the camera module, formed in a shape that allows for secure insertion of the camera module, is pre-installed on the printed circuit board. Then, the camera module is inserted into the electrical connector to electrically engage therewith. Consequently, the camera module is electrically connected with the printed circuit board via the shielded connector.

Traditional connector at least comprises a metal housing and a terminal contact received in the housing. The housing is composes of four walls perpendicular and adjacent to each other. In order to retain the camera module into the housing, said metal shell, in general, defines a plurality of locking fingers, which extending from a wall of the housing into a center of the housing. For example, the locking finger extends from the middle part of the wall of the metal housing into the center of the housing. For prevent the camera module are scraped during the process of camera insertion, the end of the locking finger is smooth. Finally, the camera module is retained in the housing by the elastic force of the locking finger. In addition, each terminal contact at least includes a contact portion, which contacting with the pad formed on the bottom surface of the camera module, a base portion attached to the housing. The signal of the camera module is transmitted to the printed circuit board via the terminal contact.

However, in the configuration of above connector, the locking finger is formed from a wall of the metal shell towards the center of the housing. Therefore, the length of the locking finger is such enough that the elasticity of the locking was poor after the connector is used often and often. Furthermore, the camera module is not retained steadily and the reliable electrical connection is not ensured.

Thus, there is a need to provide an improved shielded connector that overcomes the above-mentioned problems.

BRIEF SUMMARY OF THE INVENTION

Accordingly, it is an object of the present invention to provide a shielded connector at least having a prolonged latch for providing a reliable retaining force to positioning an electrical component therein.

In order to achieve the objective above, a shielded connector in accordance with a preferred embodiment of the present invention comprises a housing configured by a base defining peripheral edges and four sidewalls extending upwardly from the edges of the base and a spring disposed on the base of the housing. Wherein at least one of the sidewalls configured by a flexible portion and a fixed portion, the flexible portion extending from the adjacent sidewall and including a latchable portion extending towards the opposite sidewall of the adjacent sidewall.

Compare to the traditional connector, present invention defines a sidewall configured by a flexible portion and a fixed portion, the flexible portion extending from the adjacent sidewall and including a latchable portion extending towards the opposite sidewall of the adjacent sidewall. Therefore, the flexible portion bent towards the adjacent sidewall and then extended to the opposite sidewall. Consequently, compare to the tradition connector, the length of the flexible portion is increased and in result the elasticity thereof is improved. And finally, a reliable retaining force is provided for positioning the electronic component therein.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

A shielded connector according to the present invention is applicable to an electronic apparatus such as digital cameras, PDAs (Personal Digital Assistants), PCs (Personal Computers), mobile phones or the like. In the preferred embodiment illustrated in FIGS. 1-3, the shielded connector 1 is used in a mobile handset (not shown) for connecting a camera module (not shown) to a PCB (not shown).

Figure 2:
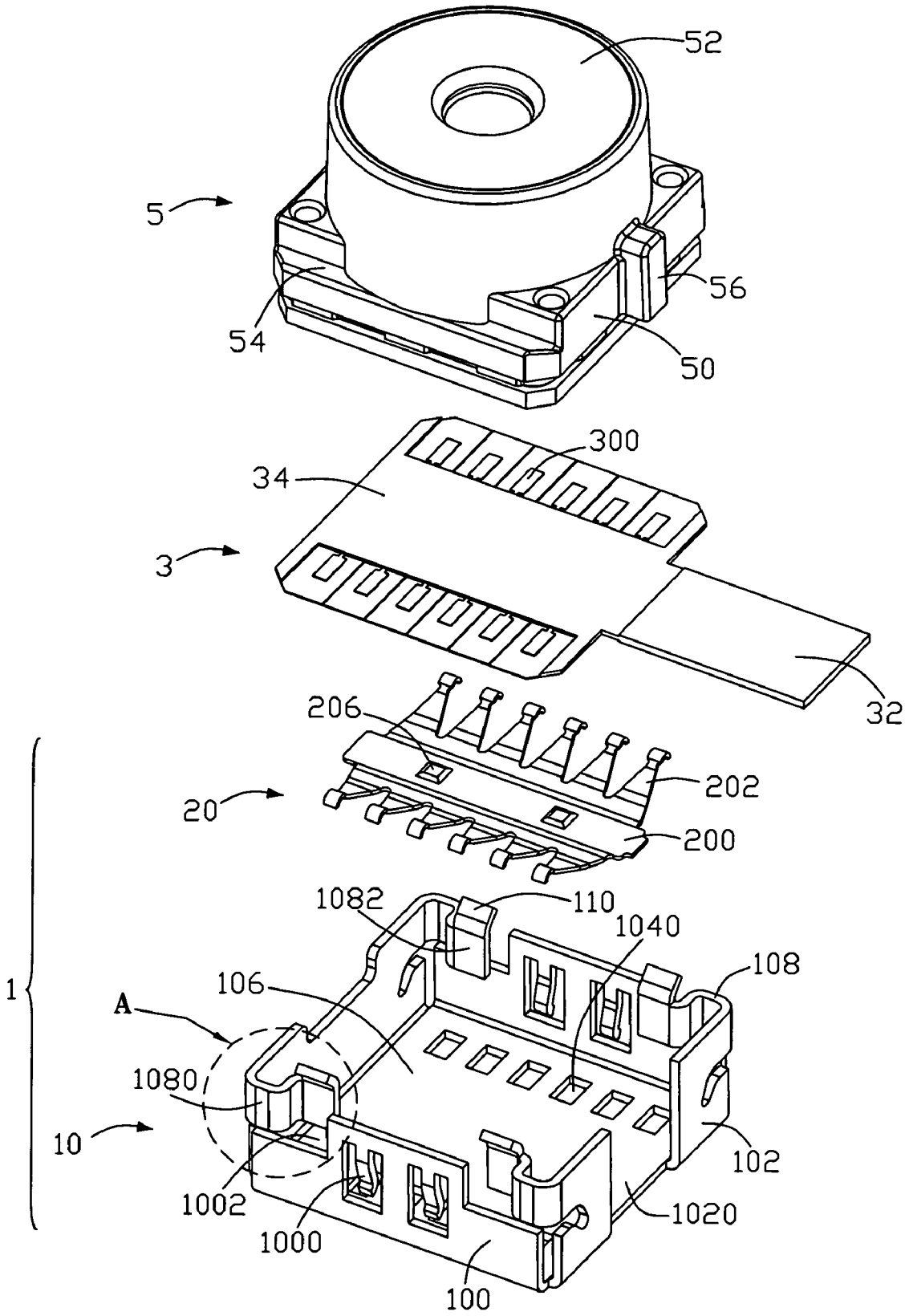
FIG. 2 is a exploded view of the shielded connector of the present invention.

FIG. 2 is an exploded perspective view of the shielded connector 1 for receiving a camera module 5 in the embodiment of this invention. In the figure, the reference numeral 10 denotes a metal housing made of metal material. The reference numeral 20 denotes a spring made of metal plate. The reference numeral 3 denotes a flexible printed board. The numeral 5 denotes a camera module attached into the center of the housing.

The metal housing 10 is made of metal material and configured by a pair of first sidewall 100, a pair of second sidewall 102 adjacent and perpendicular to the first sidewall 100, and a bottom wall (not shown) connected the first and second sidewall 100, 102 together. A receiving space 106 is formed between the first and second sidewalls 100, 102 so as to accommodate the camera module 5. In addition, said first and second sidewall 100, 102 is not connected to each other. In other words, each of them is bent vertically from the edge of the bottom wall. Therefore, said configuration will provide better elastic property when the camera module 5 is inserted into said housing 10.

A window 1020 is provided on one second sidewall 102 for engaging with a corresponding portion of the camera module 5 in order to prevent the camera module 5 from being wrongly received in the receiving space 106; meanwhile, said window 1020 also can provide a path for the flexible printed board 3 through out from the receiving space 106. A plurality of elastic fingers 1000 is formed on the first sidewall and extends slantly thereof to the receiving space 106 so as to engage with the exterior surface of the camera module 5. A pair of openings 1002 is provided on the two side of the elastic finger 1000, which extending to the portion connected to the second sidewall 102. Accordingly, a plurality of locking fingers 108 is formed on an end side of the second sidewall 102 and disposed on the opening 1002 of the first sidewall 100. Each locking finger 108 includes a U-shape portion 1080 and a retaining portion 1082 disposed on the end of the U-shape portion 1080. One leg of the U-shape portion 1080 disposed on the second sidewall 102 and integrated with the second sidewall 102, the other leg is disposed on the opening 1002 of the first sidewall 100. And the retaining portion 1082 comprises a retaining section (not shown) parallel to the direction of the camera module 5 inserting and a slant surface 110 disposes on the top edge of the retaining section 1082. Wherein, the retaining section 1082 is provided to against with the exterior surface of the camera module 5 and the slant surface 110 is provided to lead to the insertion of the camera module 5.

Referring again to FIG. 2, the spring 20 is made of metal plate and disposes on the bottom wall of the housing 10. The spring 20 includes a plate body 200 against with the bottom wall of the housing 10 and a plurality of contact portion 202 extending from two edge of the plate body 200 and away thereof so as to the contact portion 202 being above on the bottom wall of the housing 10. Accordingly, corresponding slots 1040 are formed on the bottom wall of the housing 10 for increasing the movement space of the contact portion 202 of the spring 20. Additionally, at least a projection 206 is formed on the top surface of the plate body 200 to reduce the excess elastic distortion of the spring 20 during the insertion of the camera module 5.

A flexible printed board 3 is provided on the top surface of the spring 20 and through out the housing 10 from the window 1020. The flexible printed board 3 includes a first portion (not shown) receiving in the receiving space 106 and a second portion 32 disposed out of the receiving space 106 of the housing 10. The first portion defines a plurality of electrical pads 300 on the top and down surface thereof so as to electrical connect the camera module 5 to another printed circuit board. Wherein, a reinforce element 34 is provided on a portion of the top surface of the first portion, where the electrical pads 300 is not disposed.

A camera module 5 is provided into the receiving space 106 of the housing 10 and comprised a base portion 50 and a cylindrical portion 52 disposed on the top surface of the base portion 50. The base portion 50 has a corresponding shape with the housing 10 and is completely received in the receiving space 106; the cylindrical portion 52 is disposed out of the housing 10. A step portion 54 is formed on a side surface of the base portion 50 engaging with the retaining portion 1082 of the locking finger 108 of the housing 10. A strip portion 56 is formed on another side surface thereof and corresponding to the window 1020 of the housing 10. And said strip 56 is only one on the surface of the base portion 50. Thereby, it is impossible that the camera module 5 inserts into the receiving space 106 incorrectly because of the strip 56.

Assembly, firstly, the spring 20 and the flexible printed board 3 are attached to the receiving space 106 of the housing 10 in turn. Wherein, the down surface of the plate body 200 of the spring 20 against with the middle portion of the bottom wall of the housing 10 and each contact portion 202 disposes above on the corresponding slot 1040; the down surface of the first portion of the flexible board 3 against with the top surface of the spring 20 and the second portion 32 extends out of the housing 10 via the window 1020. Finally, when the camera module 5 is inserted into the receiving space 106 from above in the leading of the slant surface 110 of the locking finger 108 of the housing 10, the contact pads formed on the bottom wall thereof are brought into contact with the electrical pads 300 of the first portion of the flexible printed board 3. Wherein, the elastic fingers 1000 of the housing 10 resist the peripheral of the base portion 50 of the camera module 5, the locking finger 108 engaged with the step portion 54 of the base 50 of the camera module 5, and the strip 56 disposes on the window 1020.

In the process of the camera module 5 being inserted, the contact portion 202 of the spring 20 produces an elastic deform with the camera module 5 inserted. The contact portion 202 of the spring 20 does not stop moving until the projection 206 is sandwiched by the top surface of the spring 20 and the camera module 5 tightly. At this time, the camera module 5 arrived the ultimately position and attached to the housing 10 firmly.

Figure 1:
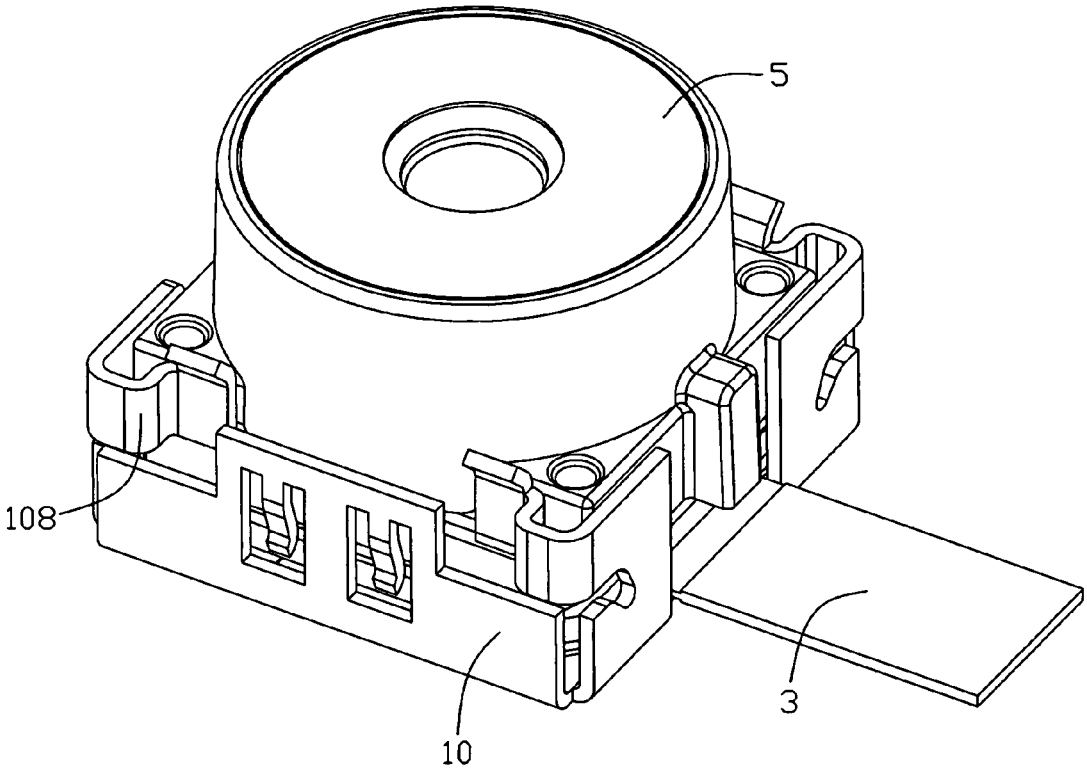
FIG. 1 is an perspective view of a shielded connector of the present invention.
Figure 3:
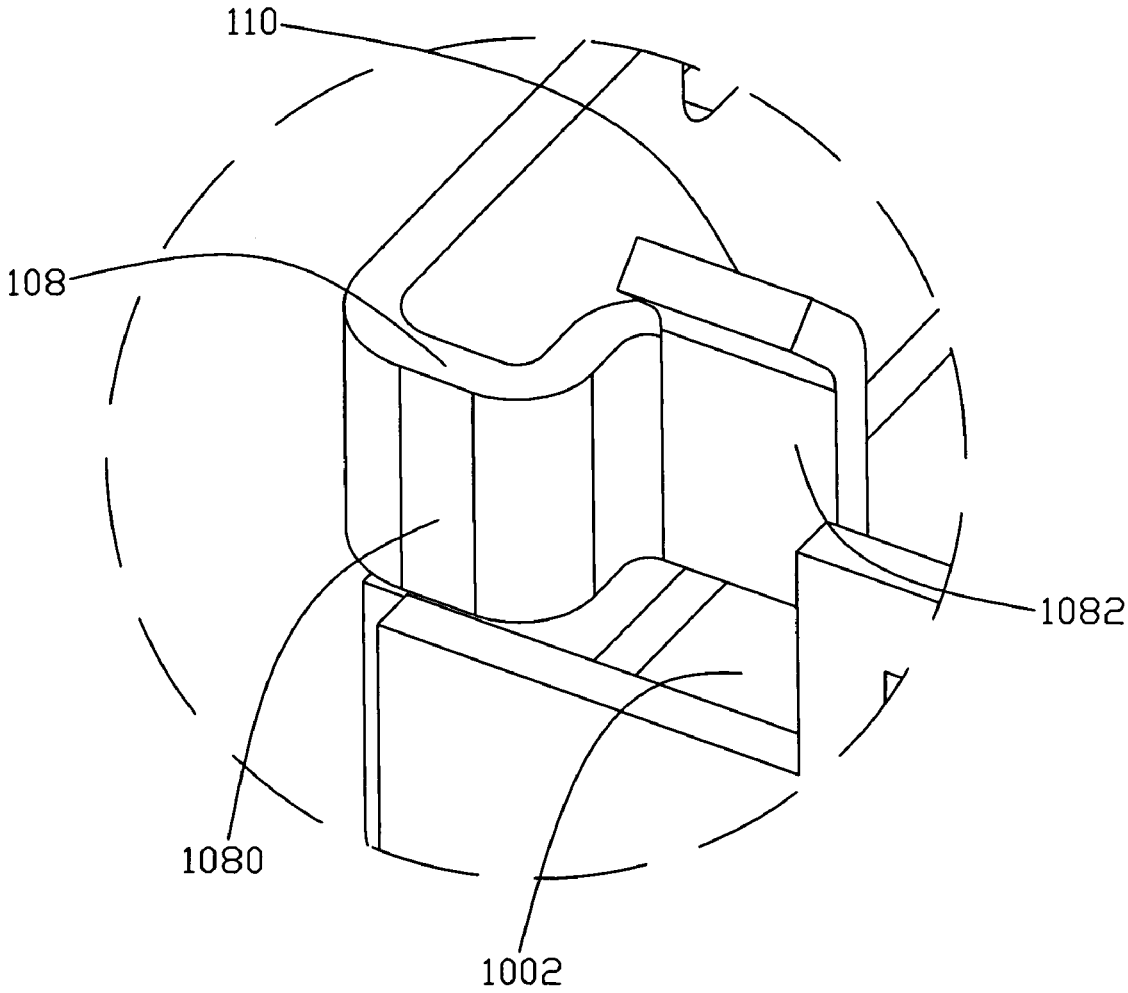
FIG. 3 is a enlarged view of the circle A of FIG. 1.

The present invention is not limited by the embodiments illustrated in FIGS. 1-3, but can be modified of altered within the scope of the invention.

In other embodiment, the locking finger 108 at least includes a first portion, which connected or integrated with the second sidewall of the housing, and a second portion, which disposes on the opening of the first sidewall of the housing and extends into the receiving space. As for the middle portion between the first and second portion, it can be any configuration.

In the above description of the preferred embodiment, the locking finger extends from the second sidewall to the first sidewall, and finally, extending from the first sidewall to the receiving space, thereby the length of the locking finger is increased. Therefore, the elastic property of the locking finger is improved and a better retaining force, which supports the camera module, is provided.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A shield connector assembly comprising:

a metallic housing including a bottom wall and a plurality of side walls commonly defining a receiving space;

one of said side walls defining an opening to allow a flexible printed circuit to extend therethrough; and a pair of cantilevered flexible portions unitarily extending from said one of the side walls and beyond two opposite ends of said one of the side walls and further angularly bent to become portions of the two opposite side walls neighboring to said one of the side walls; wherein the distal ends of said pair of cantilevered flexible portions inwardly extend into the receiving cavity and toward each other so as to function as a locking section for downwardly retaining a camera module in the receiving cavity.

2. The shield connector assembly as claimed in claim 1, wherein said two opposite side walls further define spring fingers for transversely engaging side faces of the camera module.

3. A shield connector assembly comprising:

a metallic housing including a bottom wall and a plurality of side walls commonly defining a receiving cavity;

one of said side walls defining an opening to allow a flexible printed circuit to extend therethrough along a first direction; and two pairs of cantilevered flexible portions unitarily extending from said one of the side walls and a second side wall opposite to said one of the side walls, and further angularly bent to become portions of the two opposite side walls neighboring to said one of the side walls and the second side wall; wherein the distal ends of said cantilevered flexible portions form locking sections in such a manner that the locking sections engage a camera module along a second direction perpendicular to the first direction.

4. The shield connector assembly as claimed in claim 3, wherein said two opposite side walls further define spring fingers for transversely engaging side faces of the camera module along the second direction.

* * * * *